United States Patent [19]

Yoshida

[11] 4,010,520

[45] Mar. 8, 1977

[54] COUPLING ELEMENT FOR SLIDE FASTENER

[75] Inventor: Hiroshi Yoshida, Uozu, Japan

[73] Assignee: Yoshida Kogyo Kabushiki Kaisha, Japan

[22] Filed: Feb. 24, 1976

[21] Appl. No.: 660,915

[30] Foreign Application Priority Data

Feb. 27, 1975 Japan ..... 50-27315[U]
Mar. 6, 1975 Japan ..... 50-27764

[52] U.S. Cl. ..... 24/205.13 R
[51] Int. Cl.[2] ..... A44B 19/02
[58] Field of Search ..... 24/205.13 R

[56] References Cited

UNITED STATES PATENTS

| | | | |
|---|---|---|---|
| 2,275,454 | 3/1942 | Miller | 24/205.13 R |
| 2,489,718 | 11/1949 | Morin | 24/205.13 R |
| 2,622,295 | 12/1952 | Mikulas | 24/205.13 R |

*Primary Examiner*—Bernard A. Gelak
*Attorney, Agent, or Firm*—Bucknam and Archer

[57] ABSTRACT

A coupling element for a slide fastener comprises a head portion of substantially uniform thickness, and a coupling projection projecting from one surface of the head portion. A pair of tape edge clamping legs extend from the head portion in spaced-apart relation to each other. The legs have inner flat surfaces which face each other and are adapted to grip a tape edge in surrounding relationship therewith, and a pair of outer convex surfaces which face away from each other and with which a slider is slidably engageable when the latter is manipulated to open and close the slide fastener. Each of the legs is transversely tapered from the outer surface toward the inner surface to provide trapezoidal transverse cross-sectional shape thereof. A method of making the coupling element is also provided.

2 Claims, 7 Drawing Figures

COUPLING ELEMENT FOR SLIDE FASTENER

BACKGROUND OF THE INVENTION

Field of the Invention

This invention generally relates to a slide fastener and more particularly, to a coupling element for a slide fastener and a method of making the same.

Prior Art

In manufacturing fastener coupling elements of a discrete formation, it is one of the commonly employed techniques to stamp out flat blank sheet metal to a given configuration. The coupling elements thus produced have pairs of tape edge clamping legs of a substantially square cross section. A problem experienced with these prior art coupling elements is that the legs when pressed against an element-carrying tape edge for gripping engagement therewith, are unable to bite sufficiently deep into the tape edge due primarily to the wide tape gripping surfaces of the legs. The attached coupling elements are therefore susceptible to displacement from a proper position on the tape edge when subjected to repeated external stresses applied in the use of the slide fastener, resulting in disturbed pitches or distances between adjacent coupling elements and thus, in malfunctioning of the slide fastener. Another difficulty with the conventional coupling elements formed from flat blank sheet is that the coupling elements are subjected to varying stresses because interlocking engagement between the opposed coupling heads is much larger in strength than gripping engagement of the element legs with the tape edges.

Furthermore, the use of flat blank sheet metal is disadvantageous in that when stamping out the sheet metal, cutting blade and blade supporting parts are subjected to severe shock loads and a high rate of wear. Such wear is primarily induced by the impacting contact occurring at one time between the entire length of the cutting blade and the entire surface of the sheet metal during stamping operation. This has led to the drawback that the worn members need be replaced at short intervals of time and the production rate of the coupling elements becomes reduced due to frequent replacement of such members.

SUMMARY OF THE INVENTION

With these prior art deficiencies in view, it is a principal object of the invention to provide a coupling element for a slide fastener which has a pair of tape edge clamping legs capable of biting into an element-carrying tape edge with maximum strength so as to maintain a pitch or distance between adjacent coupling elements constant during extensive use of the slide fastener.

Another object of the invention is to provide a coupling element for a slide fastener which permits of smooth movement of a slider thereon.

Still another object of the invention is to provide a coupling element for a slide fastener which has clamping legs of sufficient mechanical strength to come into gripping engagement with a tape edge and a coupling head calibrated to maintain sufficient strength of coupling engagement with a mating head.

Yet another object of the invention is to provide a method of making the coupling elements at an increased production rate by progressively pressing blank sheet metal.

According to the invention, there is provided a coupling element for a slide fastener comprising a head portion of substantially uniform thickness, and a coupling projection projecting uniform thickness, and a coupling projection projecting from one surface of the head portion. A pair of tape edge clamping legs extend from the head portion in spaced-apart relation to each other. The legs have inner flat surfaces which face each other and are adapted to grip a tape edge in surrounding relationship therewith, and a pair of outer convex surfaces which face away from each other and with which a slider is slidably engageable when the latter is manipulated to open and close the slide fastener. Each of the legs is transversely tapered from the outer surface toward the inner surface to provide trapezoidal transverse cross-sectional shape thereof. A method of making the coupling element is also provided.

Other objects and advantages of the invention will become more readily apparent from a consideration of the following description and the accompanying drawings.

DETAILED DESCRIPTION OF THE PREFERRED EMBODIMENTS

Figure 1:
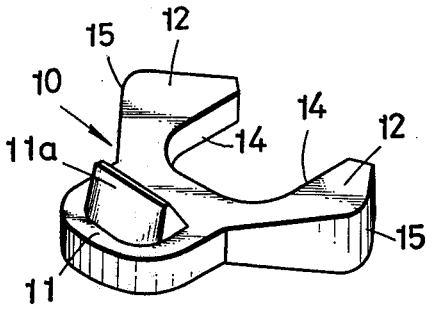
FIG. 1 is a perspective view of a coupling element for a slide fastener constructed in accordance with the invention.
Figure 2:
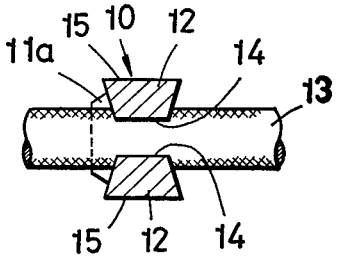
FIG. 2 is a vertical cross-sectional view of the coupling element shown in FIG. 1 which is mounted on an element carrying edge of a fastener stringer tape.

Referring now to FIGS. 1 and 2, a coupling element 10 for a slide fastener provided in accordance with this invention is formed by pressing blank sheet metal and broadly comprises a head portion 11 of substantially uniform thickness and a pair of spaced-apart legs 12 extending from the head portion 11 and adapted to clamp one longitudinal edge 13 of each of a pair of fastener stringer tapes. The head portion 11 has on its one surface a coupling projection 11*a* projecting therefrom for coupling engagement with a mating element on an opposed stringer tape when the slide fastener is closed by a slider.

The legs 12 are provided with a pair of inner flat surfaces 14 which face each other and are adapted to grip the tape edge 13 in surrounding relationship therewith, and a pair of outer convex surfaces 15 which face away from each other and with which the slider is slidably engageable when it is manipulated to open and close the slide fastener. Each of the legs 12 is transversely tapered from the outer surface 15 toward the inner surface 14, providing trapezoidal transverse cross-section thereof as shown in FIG. 2. The thickness of the legs 12 at the inner surfaces 14 is substantially equal to that of the head portion 11. Thus, the thickness of the leg 12 at the outer convex surface 15 is larger than that of the head portion 11.

When the coupling element 10 is to be mounted on the tape edge 13, the tape edge gripping legs 12 are held in place astride of and then, are pressed against the tape edge 13 in a manner well known in the art. With the tapered or trapezoidal cross-section of the legs 12, the inner surfaces 14 are thrusted relatively deep into the tape edge 13, until they bite into the tape edge 13 with maximum strength.

The outer surfaces 15 have relatively wide areas of contact with the slider and, hence, allow the smooth sliding movement of the slider thereon.

Figure 3:
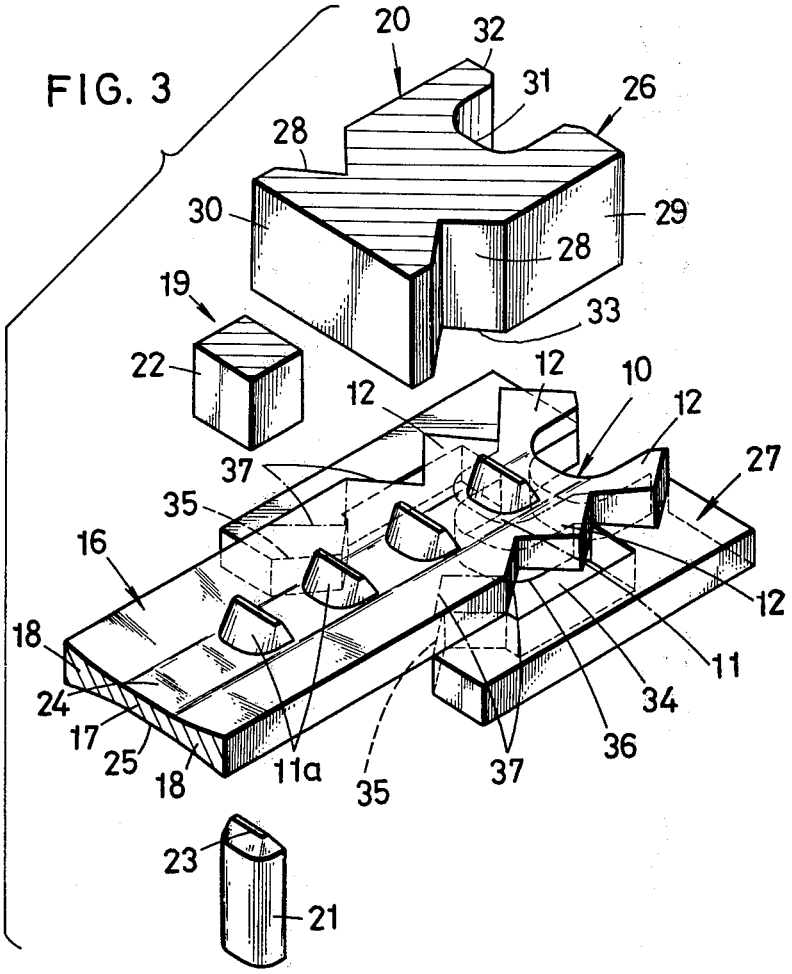
FIG. 3 is a schematic exploded perspective view showing the way in which the coupling elements are sequentially produced in accordance with the method of the invention.

A method of making the coupling elements 10 according to the invention will be described in detail with reference to FIG. 3. The blank sheet metal from which the coupling elements 10 are successively formed is in the form of a web 16 made of aluminum, brass, red brass or other suitable material. The web 16 has a flat central portion 17 which extends longitudinally of the web 16 and from which the head portions 11 are formed, and a pair of marginal portions 18 which are integral one with each side of the central portion 17 and from which the pair of legs 12 are formed. Each of the marginal portions 18 is transversely tapered toward the central portion 17 in order to provide the trapezoidal cross-sectional shape for produced element legs 12. The element-forming web 16 is fed intermittently to first and second die stations 19, 20 in a press at which the web 16 is successively formed into the coupling elements 10 in the manner described below.

The first die station 19 includes a punch 21 located below the web 16 and a die 22 above the web 16, the punch 21 and the die 22 being vertically movable toward and away from each other and jointly serving to form the coupling projections 11*a* on the web central portion 17. The punch 21 has on top end a punch edge 23 and the die 22 has in its lower side a recess (not shown), the punch edge 23 and the recess being complemental in shape to one another. When the first die station 19 is actuated, the punch 21 is raised and, simultaneously, the die 22 is lowered until they are brought into contact with upper and lower surfaces 24, 25 of the central portion 17, respectively, whereupon the punch 21 is continued to move upwardly and is thrusted into the lower surface 25, thereby providing the coupling projections 11*a* drawn out of the plane of the central portion 17 away from the lower surface 25. Upon formation of the coupling projection 11*a*, the punch 21 and the die 22 are retracted away from each other toward their inoperative positions.

The second die station 20 is disposed downstream of the first die station 19 and includes a movable punch 26 located above the web 16 and a fixed die 27 beneath the web 16, on which die 27 the web 16 is slidably supported. The punch 26 cooperates with the die 27 in forming the head portions 11 and legs 12 of the coupling elements 10. The punch 26 has a pair of recesses 28 of triangular cross-section each defined in one of lateral surfaces 29 of the punch 26 and near a longitudinal front end 30, and a central recess 31 defined in a longitudinal rear end 32 and identical in horizontal cross-sectional shape to the head portion 11 of the coupling element 10. The lateral recesses 28 provide at their bottoms cutter edges 33 and the central recess 31 provide at its bottom a cutter edge (not shown).

The lower die 27 has an opening 34 defined therein and complemental in horizontal cross-sectional shape to the punch 26, thus providing a pair of lateral cutter edges 35 for coacting with the lateral cutter edges 33 of the punch 26 and a central cutter edge 36 for coating with the central cutter edge of the punch 26. When the second station 20 is actuated, the punch 26 is lowered into contact with the web 16 and, upon continued downward movement of the punch 26, the web 16 is depressed with the marginal portions 18 stamped by the lateral cutter edges 33, 35 of the punch 26 and the die 27 to form a pair of notches 37 and with the central portion 17 stamped by the central cutter edge of the punch 26 and the central cutter edge 36 of the die 27 to form the head portion 11 and the pair of legs 12, thereby producing a coupling element 10 from a front end portion of the web 16. When the formation of the coupling element 10 is completed, the punch 26 is retracted upwardly away from the die 27 toward its inoperative position.

While the punch 21, the die 22 and the punch 26 are in their retracted positions, the element-forming web 16 is advanced a given distance and stopped, when the first and second die stations 19, 20 are actuated simultaneously to form a coupling projection 11*a* and a coupling element 10. In this manner, the pressing operation is repeated in timed relationship with the intermittent feeding movement of the web 16 so as to produce coupling elements 10 successively.

Figure 4A:
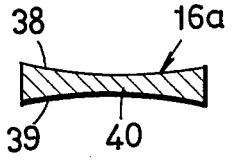
FIGS. 4A through 4D are transverse cross-sectional views illustrating a variety of shapes of blank sheet metal used for making the coupling elements of the invention.
Figure 4B:
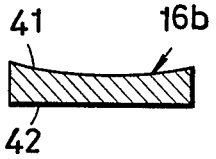
Figure 4C:
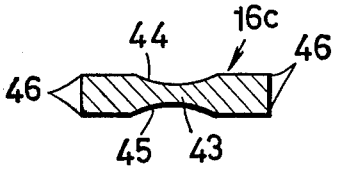
Figure 4D:
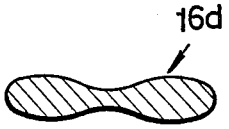

FIGS. 4A through 4D show in transverse cross-section various forms of blank webs from which coupling elements according to the invention are formed. In FIG. 4A, a web 16*a* has upper and lower concave surfaces 38, 39 extending over the entire width of the web 16*a* to provide a thinner central portion 40. A web 16*b* shown in FIG. 4B has an upper concave surface 41 and a lower flat surface 42. Another modification illustrated in FIG. 4C comprises a web 16*c* having a central portion 43 with upper and lower concave surfaces 44, 45 extending thereover. A web 16*d* of FIG. 4D is formed by rounding corners 46 of the web 16*c* shown in FIG. 4C.

With the blank web 16 having the marginal portions 18 of tapered or trapezoidal cross-sectional shape, the lateral cutter edges 33 of the punch 26 and the lateral cutter edges 35 of the die 27 are prevented from being subjected to severe shock loads and a high rate of wear, since the cutter edges 33, 35 are thrusted into the marginal portions 18 through contact with their upper and lower sloped surfaces.

While certain preferred embodiments of the invention have been shown and described, it will be understood that variations and modifications may be effected in the details thereof without departing from the scope of the appended claims.

What is claimed is:

1. A coupling element for a slide fastener having a slider and a pair of element-carrying tapes, the coupling element being adapted to be mounted on either one of the pair of tapes, comprising:

a head portion of substantially uniform thickness;

a coupling projection projecting from one surface of said head portion for intercoupling engagement with a coupling element on the other tape; and a pair of tape edge clamping legs extending from said head portion in spaced-apart relation to each other, said pair of legs having a pair of inner flat surfaces which face each other and are adapted to grip the tape edge in surrounding relationship therewith, and a pair of outer convex surfaces which face away from each other and with which the slider is slidably engageable when the latter is manipulated to open and close the slide fastener, each of said legs being transversely tapered from said outer surface toward said inner surface to provide trapezoidal transverse cross-sectional shape thereof.

2. A coupling element according to claim 1, said head portion being substantially equal in thickness to said legs at the inner surfaces thereof.

* * * * *